US005836386A

United States Patent [19]

Haggard

[11] Patent Number: 5,836,386

[45] Date of Patent: Nov. 17, 1998

[54] WIPING ELEMENT FOR A DRILL PIPE ID WIPING DEVICE

[76] Inventor: Archie Haggard, 2922 Teague, Houston, Tex. 77080

[21] Appl. No.: 696,123

[22] Filed: Aug. 13, 1996

[51] Int. Cl.[6] ..... E21B 37/04

[52] U.S. Cl. ..... 166/177.3; 166/153

[58] Field of Search ..... 166/170, 177.3, 166/182, 187, 153

[56] References Cited

U.S. PATENT DOCUMENTS

| | | | |
|---|---|---|---|
| 1,369,891 | 3/1921 | Halliburton | 168/153 |
| 2,514,817 | 7/1950 | Wheaton et al. | 166/177.3 X |
| 2,601,614 | 6/1952 | Johnson | 166/153 |
| 2,740,480 | 4/1956 | Cox | 166/177.3 X |
| 2,785,757 | 3/1957 | Middleton | 166/177.3 X |
| 4,083,074 | 4/1978 | Curtis | 166/153 X |
| 4,221,264 | 9/1980 | Haggard | 166/177.3 |
| 4,356,865 | 11/1982 | Appel et al. | 166/153 |
| 4,378,838 | 4/1983 | Ogden et al. | 166/153 |
| 4,392,528 | 7/1983 | Paulson | 166/153 |

*Primary Examiner*—Frank Tsay
*Attorney, Agent, or Firm*—Gunn & Associates, P.C.

[57] ABSTRACT

An improved wiper element for a pipe ID comprising a resilient wiping element mounted on a pipe wiper mandrel. The wiper element further having oppositely disposed petals to enable wiping within a large pipe, and opposing petals are defined by transverse edge extending outwardly along the petals, wherein the edges define a corner at the outer periphery of the petals and further comprising a chamfered face at the corners the enable the corners to overlap when brought into an abutting relationship.

15 Claims, 2 Drawing Sheets

WIPING ELEMENT FOR A DRILL PIPE ID WIPING DEVICE

BACKGROUND OF THE DISCLOSURE

This disclosure is directed to a wiping device for use in drill pipe and in particular a drill string formed by several diameters of drill pipe. When drilling a shallow well, it is normally drilled with only a single size drill pipe. The string of drill pipe is assembled at the surface and pipe is added to the drill string until the well reaches total depth (TD). This situation commonly prevails in wells drilled at low pressures into relatively shallow formations. When drilling into a deeper formation, it is not uncommon to reduce the size of the drill pipe at the lower end. Thus, the drill stem is typically made up of perhaps five drill collars at the very bottom to add weight and stiffness, a standard size drill pipe at the upper end and a smaller size drill pipe at the lower end of the drill string. If 5½" drill pipe is used at the top end of the string, a shift to 4½" drill pipe does not pose much of a problem as a result of the change in size. Wiping the pipe is highly desirable and in some instances is almost mandated to assure that there is no splash on the rig floor. Spilling drilling mud from the pipe as it is pulled from the well borehole during a trip is at least unsafe, and may be forbidden by environmental regulations. It is therefore common practice, although not universally so, to pull the drill pipe only after inserting an ID wiper in the drill string. While the string is being pulled up and taken apart stand by stand, the wiper is dropped in the ID to clear that surface by pushing the drilling fluid down so that each joint or stand removed is substantially clear on the ID and does not drip on the floor.

In a long drill string, the weight of the drill string sometimes is reduced by reducing the diameter of the drill pipe. Drill pipe is normally provided in a number of sizes. Transition from one size to the next smaller size does not pose much of a problem because the change is not that great. However, when a drill string is assembled with four progressively smaller sizes of drill pipe, the total change is very substantial. In particular, the change can be so great that the ID wiper cannot pass into the smallest ID drill pipe assembled in the string. This has become a problem because most shallow formations have been discovered and drilled. Over the last many years, the average depth of a well in the United States has progressively gotten deeper. As the wells become deeper, there is a greater need for reduction in weight of the drill string. As the well becomes deeper and as drilling becomes more difficult at greater depths with related increased pressures and temperatures, such wells pose a greater problem in that the deep wells may indeed require at least three or sometimes four or more sizes of drill pipe. There are drill strings now being assembled with the top pipe being 5½" tapering down to 2⅞". As the drill string is reduced, the transition for the ID pipe mechanism becomes more severe.

The pipe wiping device set forth in the Haggard patents (U.S. Pat. Nos. 4,221,264 and 4,287,948) have met with substantial commercial success. There is a limitation in the use of such equipment. It is not able to make the transition to the smaller sizes. If the ID wiper mechanism is designed for a really small size, it will not wipe the larger pipe. Therefore, it will not adequately service a drill string in which the pipe ID makes such a radical change in size. The ID wiper of this disclosure is an improved wiper element which is constructed so that wiping can be obtained in a wider range of pipe. The wiper element is formed of a planar wiping element of resilient material. Several wipers are installed on the wiper mechanism. The present disclosure sets forth an improved wiper element. In particular, it is able to wipe the interior of a very common size of drill pipe, namely, 5" pipe. It is also, however, to make the transition to smaller sizes including 2⅞" drill pipe. The wiper must have an adequate diameter to reach the inside wall of 5" pipe and yet not jam when transitioning from that size to the 2⅞" pipe. The wiper disc is cut from circular sheet stock. Spaced notches are formed in it. Loosely speaking, it resembles a flower having only two petals, and the two petals inscribe or include an angle of about 75° to 90°. Because there are internal upsets in the pipe, the sheet resilient material is required to flex or fold on encountering changes in pipe size. This bends or folds the two protruding petals. They are permitted to bend until they close, almost encircling the central support mandrel, and when this occurs, the edges of the petals jam against each other, thereby forming a circular plug of sufficient thickness that further movement is not permitted. At that size, it is not possible for the resilient wiper element to fold and enter the smaller diameter pipe. The present disclosure utilizes a resilient or rubber wiper which is constructed with a pair of petals having a finite thickness and resiliency. The thickness is essential for a durable wiper. On the other hand, the thickness of the two petals creates an abutting and hence a locking mechanism which is excessively large. While the mandrel may be made small enough, and the cuts defining the two petals extend radially inwardly by an adequate distance, it is not possible for the wiper to otherwise fold and pass through the narrow passage in the smaller pipe. Surprisingly, the wiper element of the present disclosure permits such passage and enables passage by overlapping the petals so that they do not jam and define an excessively large diameter shoulder on the ID wiper preventing passage. Details of this construction will be set forth below.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

FIG. 4 is the plan view comparable to FIG. 1, FIG. 5 is a side view, and FIG. 6 shows the wiper folded for entry into the smaller ID pipe.

DESCRIPTION OF THE PREFERRED EMBODIMENT

Figure 1:
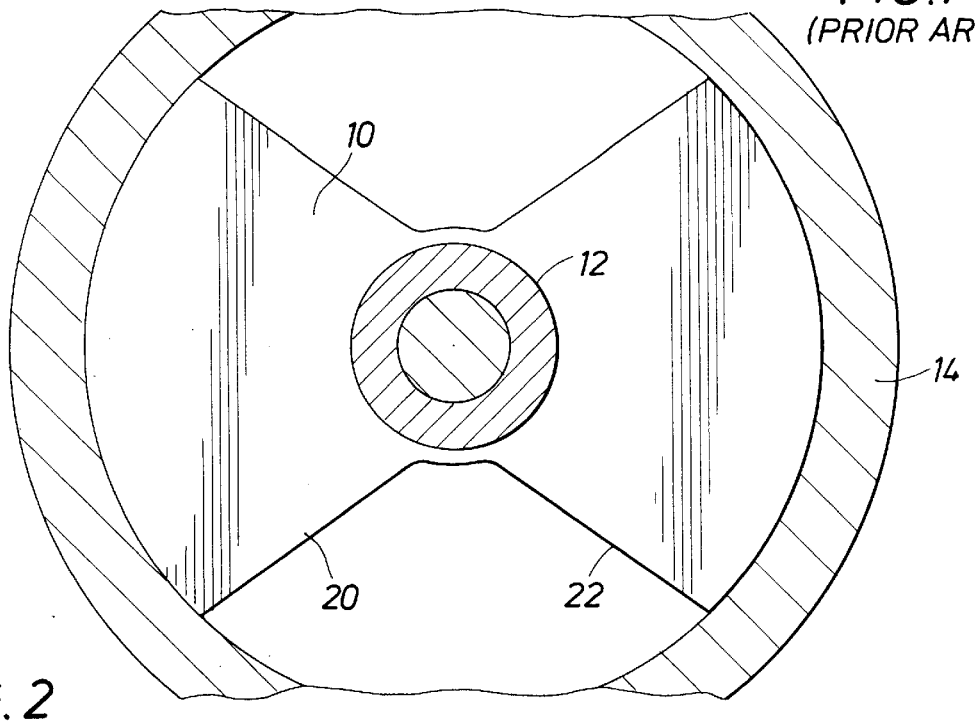
FIG.1 (PRIOR ART)
FIGS. 1, 2 and 3 show the pipe ID wiper of the prior art and illustrate a plan view of the wiper in FIG. 1, a side view of the same wiper in FIG. 2, and the wiper folded on entry to a smaller ID pipe to set forth the problem.
Figure 2:
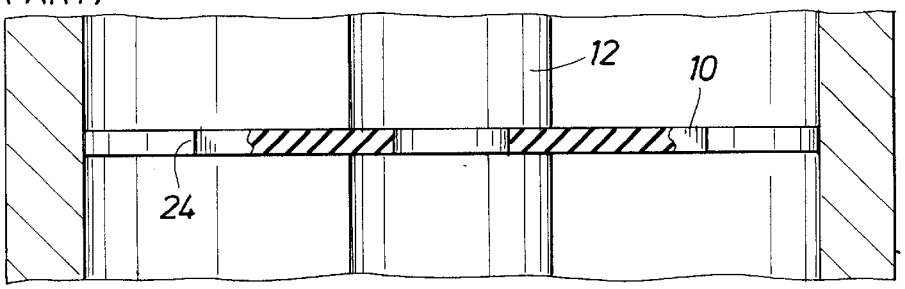
FIG. 2 (PRIOR ART)
Figure 3:
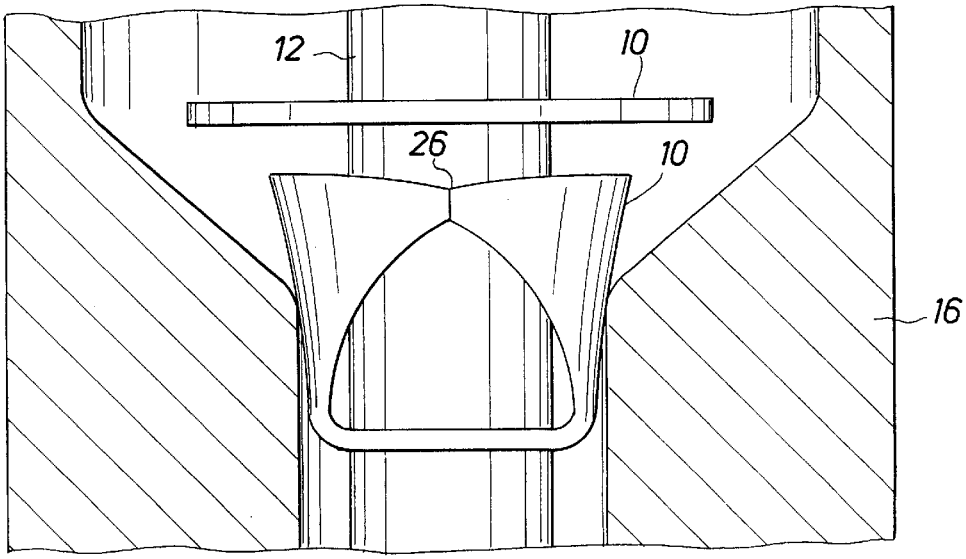
FIG.3 (PRIOR ART)

Attention is first directed to FIGS. 1, 2 and 3 considered jointly which show the prior art wiper to set forth the problem. That wiper will be identified with the numeral 10 and is mounted on a mandrel 12 for traversing a large ID drill pipe 14. Eventually, a transition is required from the large pipe 14 to a smaller pipe 16. As representative dimensions, the larger pipe 14 is a 5" pipe, or perhaps 5½". The smaller pipe 16 makes a transition through an appropriate reducing nipple(s) into 2⅜" or 2⅞" pipe size. This enables connection of several thousand feet of large pipe 14 with several thousand feet of smaller diameter pipe 16. The problem arises with the transition from the larger to the smaller size.

Going now to FIG. 3 of the drawings, the mandrel 12 supports the pipe wiper element 10 which is shown folded. Typically, there are two such wipers which are arranged at 90°. A second wiper 10 is also supported on the mandrel. Both wipers encounter the same problem. They are spaced vertically along the mandrel 12 so that the left and right petals 20 and 22 do not fold lengthwise along the mandrel so that the wiper elements 10 interfere with adjacent wiper elements.

As shown in FIG. 2 of the drawings, the wiper 10 is formed with a thickness enabling substantial durability. There is a finite thickness 24 which enables the rubber wiping element to maintain its strength. It is required to extend radially outwardly without hanging limply when installed. To this end, and citing a representative size, if the wiper element has a maximum diameter of 5", the thickness 24 typically ranges between preferably about 0.125. The material has a yield strength in tension of at least about 1200 psi and permits up to about 250% elongation in the plastic range. It has an adequate hardness. It is resilient and tolerates flexure without forming hairline cracks. It is able to last through several thousand flexures in which the wiper element 10 is folded as shown in the transition member in FIG. 3. When entering an internal obstruction, folding is accomplished. The failure mechanism is abrasion which ultimately wears away the wiper element 10. That abrasion impact is reduced because the drilling fluid on the pipe surface is relatively slick, and therefore serves as a lubricant. This reduces abrasion damage. For that reason, the wiper element 10 has a relatively long life.

Attention is focused on the abutting two tips 26 which fold against each other and which define a specified diameter. The wiper 10 simply cannot get any smaller than that. Even though it is made of resilient material, entrance into the smaller ID pipe is forbidden as a result of the abutment of the corners of opposite petals. FIG. 3 thus shows this abutting relationship at 26 and illustrates the blocking or plugging problem in that the wiper can proceed no farther.

Figure 4:
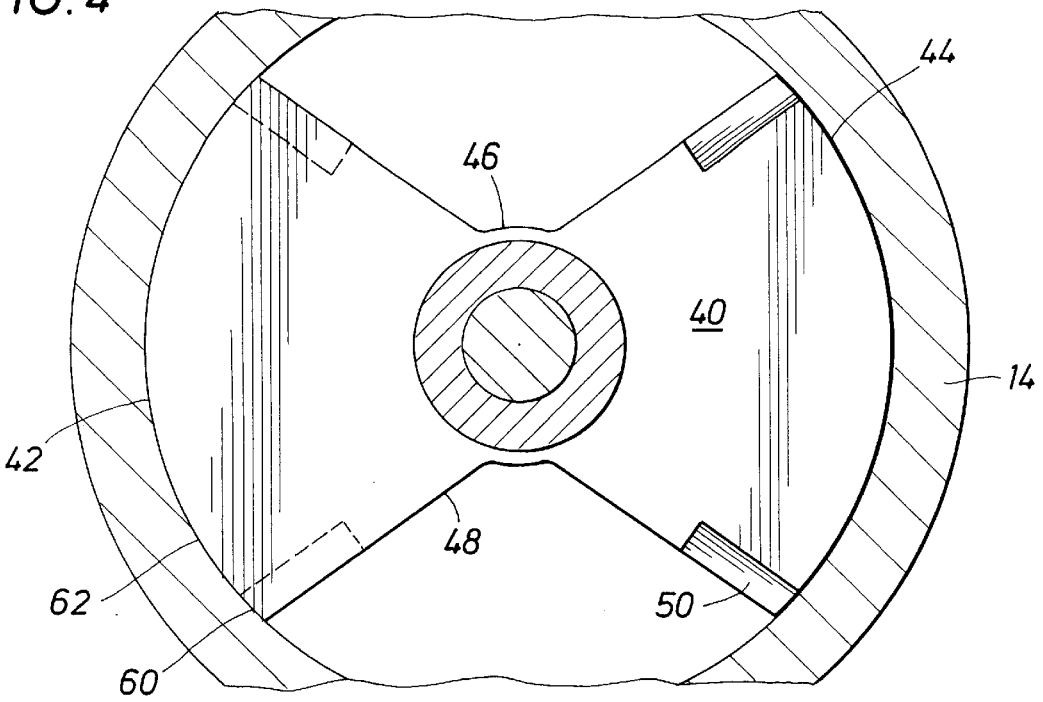
FIGS. 4, 5 and 6 together show the improved pipe wiper of the present disclosure where
Figure 5:
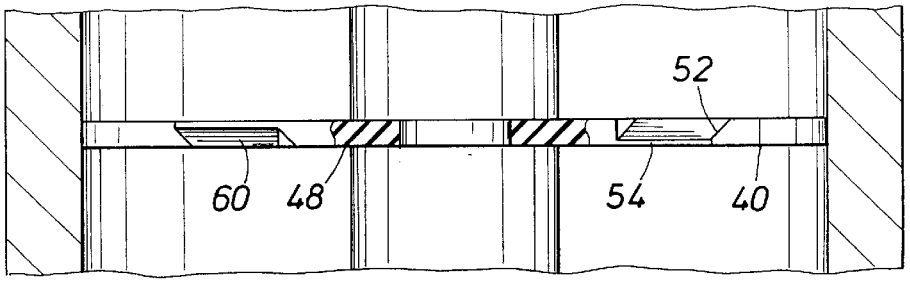
Figure 6:
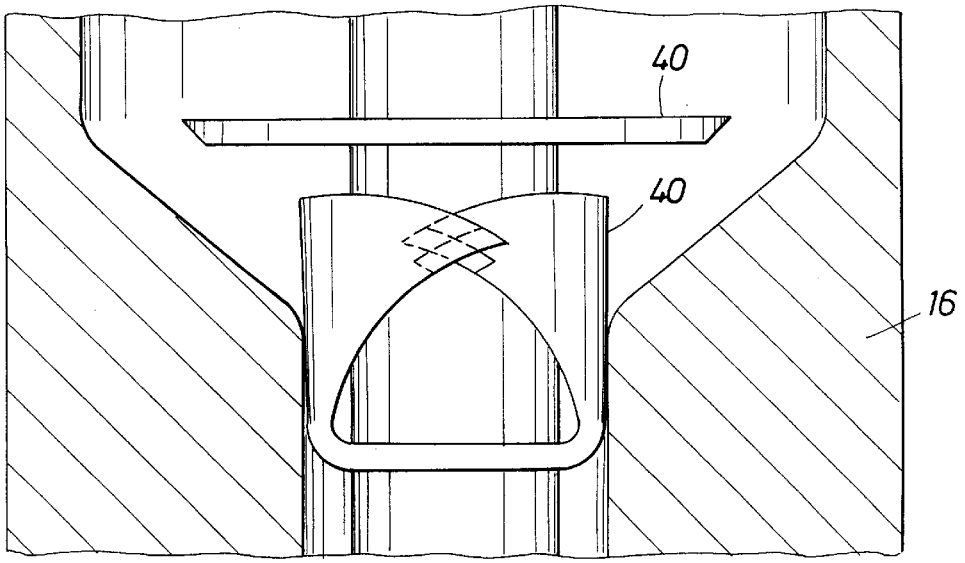

Going now to the present invention, attention is directed jointly to FIGS. 4, 5 and 6. Together they show the wiper element of the present disclosure in the same fashion. The wiper element 40 is shown in plan view in FIG. 4. It is shown in side view in FIG. 5, and is shown at two locations in FIG. 6. There is a transverse wiper element 40 shown in FIG. 6 positioned at right angles above the folded wiper element 40. The folded wiper element is able to overlap and therefore becomes smaller. It becomes sufficiently small that it can enter into a smaller ID pipe. Going back now to FIG. 4, the wiper element 40 is made of the same material as the wiper element 10. It is constructed with left and right petals 42 and 44. They inscribe angles of about 75° to about 90°. They are symmetrically deployed about the centerline of the circular disc making up the wiper element 40. The circular disc is cut with the upper notch 46 and the corresponding lower notch arranged oppositely of the centerline axis of the circular disc. As shown in FIG. 5, the material has the same thickness. As also shown in FIG. 5, the notches 46 define vertical edges or faces 48. The edge 48 extends radially outwardly as also shown in FIG. 4 and defines a vertical plane for the face 48. At the outer portions of the face 48, a notch 50 is formed at an angle. The notch 50 does not change the profile as shown in the plan view of FIG. 4. Rather, the notch is a chamfer defining a slopping face 52. The tapered face 52 slopes at approximately 45°. The notch 50 (shown in FIG. 4 at the right) is on the top face while the corresponding but opposite notch 60 is on the lower face. The notches 50 and 60 are equal preferably and therefore match so that they can permit overlapping. The notches 50 and 60 are constructed without tapering to a razor edge. As shown in FIG. 5, there is a narrow lower face portion 54 which shows how the taper does not define an extremely sharp edge. This is accomplished in both notches. By cutting away a portion at the two respective corners, the two petals are then permitted to overlap. The upstanding vertical faces 48 are therefore modified by the notches 50 and 60. The notches 50 and 60 preferably have approximately equal radial extent along the faces 48. The notches are constructed and arranged so that they meet and match. The circular extent of the two notches around the periphery is not required to extend a great distance around the circle. As will be understood, the circular outer face 62 maintains the same thickness around the two symmetrical portions 42 and 44. This face or edge is the surface that accomplishes wiping. That face is preferably left full thickness for most of the circular extent. In other words, weakening of the outer edge or face 62 is not a problem in the present apparatus.

The resilient wiper element permits folding of the left petal 42 which then is able to overlap petal element 44. Folding and overlapping is shown now in FIG. 6 of the drawings. There, the respective notches 50 and 60 line up and are brought into contact with each other. When that contact occurs, the vertical face 48 across the narrow dimension of the wiping element does not create the problem that was encountered heretofore. In the past, the petals 42 and 44 would abut as shown in FIG. 3; in this instance, they are forced toward each other so that the outer corners contact, but the feature of the present disclosure incorporating the chamfered and tapered notches 50 and 60 permits them to form an overlap. The overlap enables the wiper element to fit within a smaller diameter circle and thereby enter the smaller pipe. As shown in FIG. 6, the smaller pipe 16 is readily able to receive the wiper element in transition from the larger pipe 14 shown above.

The present disclosure therefore enables wiping through a smaller diameter pipe after having successfully wiped a larger diameter pipe even to the extent of wiping 5" or 5½" pipe and then making the transition into 2⅞" pipe. This transition from a large to small pipe enhances the wiper mechanism mentioned in the Haggard patents noted above thereby extending the protection of the wiping system to pipe strings currently in the vogue. The modified wiper element of the present disclosure is therefore preferably formed of the same material and is cut with the same profile. The plan view of FIG. 4 provides a wiper element which matches the plan view of FIG. 1. The modification to enable transition into the smaller pipe permits the wiper element to flex and thereby enter smaller pipe and also tends to reduce the abrasion on the nether face of the wiper. As shown in FIG. 6, folding over into a more narrow diameter is accomplished with the benefit that the bottom face is subjected to reduced loading while abrasion occurs. The reduced loading extends the life of the wiper element.

While the foregoing is directed to the preferred embodiment, the scope thereof is determined by the claims which follow.

I claim:

1. An improved wiper element for a pipe ID wiper comprising a resilient wiping element mounting on a pipe wiper mandrel and further having oppositely disposed petals to enable wiping within a large pipe, and wherein the opposing petals are defined by a transverse edge extending outwardly along said petals, and wherein said edges define a corner at the outer periphery of said petals, and further comprising a chamfered face at said corners to thereby enable said corners to overlap when brought into an abutting relationship.

2. The apparatus of claim 1 wherein said petals inscribe an angle of about 75° to about 90° and said abutting edges are edge defining faces at right angles to the plane of said wiper element.

3. The apparatus of claim 2 wherein said chamfered face has a taper of about 45°.

4. The apparatus of claim 2 wherein said chamfered face has a length of about ⅓rd of said transverse edge.

5. The apparatus of claim 2 wherein said wiper element has a circular mounting hole.

6. The apparatus of claim 2 wherein said chamfered face is adjacent to an outer peripheral face of said wiper.

7. The apparatus of claim 2 wherein said chamfer on one of said oppositely disposed petals is relatively at the top thereof and the chamfer at the other of said oppositely disposed petals is at the bottom thereof.

8. The improved wiper of claim 1 wherein the resilient wiping element has a central opening to permit mounting on a pipe wiper mandrel and wherein the opposing petals are defined by a transverse edge extending radially outwardly along said petals.

9. The apparatus of claim 8 wherein said petals inscribe an angle of about 75° to about 90° and said abutting edges are edge defining spaces at right angles to the plane of said wiper element.

10. The apparatus of claim 9 wherein said chamfered face has a taper of about 45°.

11. The apparatus of claim 9 wherein said chamfered face has a length of about ⅓rd of the radius.

12. The apparatus of claim 9 wherein said chamfer on one of said oppositely disposed petals is relatively at the top thereof and the chamfer at the other of said oppositely disposed petals is at the bottom thereof.

13. A method of enabling a transversely positioned wiper element on a pipe ID wiper to make a transition from a large to smaller diameter pipe comprising the steps of positioning a transverse wiper element on a mandrel to wipe the interior of a larger pipe, defining a radially extending edge on said wiper element extending to the outer periphery thereof, folding the wiper element so that the folded wiper element defines a n abutting edge for an oppositely disposed portion of the same wiper element, and shaping the abutting edges for overlap.

14. The method of claim 13 wherein said abutting edges are edge defining faces at right angles to the plane of said wiper element.

15. An improved wiper element for a pipe ID wiper comprising a resilient wiping element having a central opening to permit mounting on a pipe wiper mandrel and further having matching oppositely disposed petals on a circle to enable wiping within a large pipe, and wherein the opposing petals are defined by a transverse edge extending radially outwardly along said petals, and wherein said edges define a corner at the outer periphery of said petals, and further comprising a chamfered face at said corners to thereby enable said corners to overlap when brought into an abutting folded relationship.

* * * * *